United States Patent [19]

Welden

[11] 4,147,323

[45] Apr. 3, 1979

[54] CONCRETE FORMING AND CURING APPARATUS

[76] Inventor: David P. Welden, N. Indiana Ave., Iowa Falls, Iowa 50126

[21] Appl. No.: 827,888

[22] Filed: Aug. 26, 1977

[51] Int. Cl.[2] ..... B28B 7/00

[52] U.S. Cl. ..... 249/79; 425/446

[58] Field of Search ..... 249/78–81; 425/446; 432/224; 165/174; 98/40 C

[56] References Cited

U.S. PATENT DOCUMENTS 2,942,321 6/1960 Pinter et al. ..... 249/79

FOREIGN PATENT DOCUMENTS 929285 6/1963 United Kingdom ..... 98/40 C 1026986 4/1966 United Kingdom ..... 98/40 C

*Primary Examiner*—Francis S. Husar

*Assistant Examiner*—John McQuade

*Attorney, Agent, or Firm*—Henderson & Sturm

[57] ABSTRACT

Apparatus for curing concrete of a type having a mold or plurality of molds disposed on a frame is characterized by having a forced air heating system which includes a mechanism for evenly distributing heat along the length of a concrete bed. The concrete bed has a plurality of molds thereon and an opening under the molds for receiving a heat distributing mechanism. A heater is attached to the heat distributing mechanism and an air circulating mechanism is provided for causing the heat from the heater to flow to the heat distributing mechanism. The heat distributing mechanism includes a first conduit attached at one end thereof to and in communication with the heater. The first conduit has side walls which are impervious to the flow of the heated gases and the other end of the first conduit is open. A second conduit is sealingly disposed around the first conduit and encompasses the other opened end of the first conduit. An annular passageway is formed between the first and second conduits whereby heated air from the heater passes through the first conduit and out the other end thereof into the passageway. The plurality of apertures are disposed in the second conduit in communication with the passageway and in communication with the opening under the mold for substantially evenly distributing the heated gases to the molds on the bed.

4 Claims, 5 Drawing Figures

CONCRETE FORMING AND CURING APPARATUS

BACKGROUND OF THE INVENTION

The present invention relates generally to an apparatus for curing concrete and more particularly to such apparatus including a device for evenly distributing heat to a concrete bed.

In the production of large concrete structures, especially those which are to be produced at a central location and then shipped for use or sale at another location, it has become customary to lay out a plurality of molds on what is commonly referred to as a "bed". In order to accelerate the curing of the products molded in such bed, it has become customary to provide a heating structure underneath the beds so that the heat will cure the concrete more rapidly and thereby facilitate an increase in production of such products. Normally canvas covers or the like are placed over the beds and molds to help retain the heat from such heaters. Such heaters are needed even more in the winter time when concrete would not cure properly without the addition of supplemental heat.

One of the common systems for providing heat to concrete beds is the use of a central boiler which heats up water and sends steam through pipes underneath the beds for providing the necessary heat to such beds. One of the problems associated with boilers is that a great deal of heat goes up the exhaust stack in a boiler. These hot gas fumes are merely exhausted to the atmosphere, thereby wasting this energy. Furthermore, steam heat is usually piped over long distances and heat is, of course, lost in the process. Furthermore, the cost of a boiler and the piping associated therewith is extremely high.

Experiments have been made to determine the feasibility of using a forced air heating system, but these experiments have generally been unacceptable because an even distribution of heat has not been achievable in a practical way prior to the instant invention.

SUMMARY OF THE INVENTION

The present invention relates to a system for supplying heat to a concrete bed having molds thereon. An opening is disposed under the concrete bed and a heat distributing mechanism is disposed in the opening for evenly distributing heat to the mold. A heater is attached to the heat distributing mechanism and a fan is operably connected to such heater for causing the heat from the heater to flow into the heat distributing mechanism. The heat distributing mechanism includes a first conduit which is attached at one end thereof to and in communication with the heater. This first conduit has side walls which are impervious to the flow of gases and with the other end of the first conduit being open. A second conduit is sealingly disposed around the first conduit and encompasses the other open end of the first conduit. A passageway is formed between the first and second conduits whereby heated air from the heater passes through the first conduit and out the other end thereof into such passageway. An aperture structure is disposed in the second conduit in communication with the passageway and in communication with the opening under the mold for substantially evenly distributing heated gases to the concrete bed along the length of of the concrete bed.

An object of the present invention is to provide an improved apparatus for supplying heat to a concrete bed.

Another object of the invention is to provide a forced air heating system for curing concrete in molds on a concrete bed which is characterized by having a mechanism for evenly distributing heat along the length of such concrete bed.

Other objects, advantages, and novel features of the present invention will become apparent from the following detailed description of the invention when considered in conjunction with the accompanying drawings.

DESCRIPTION OF THE PREFERRED EMBODIMENT

Figure 1:
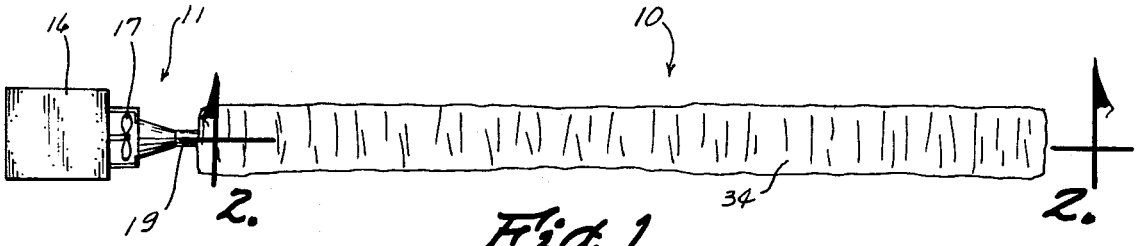
FIG. 1 is a simplified plan view of a concrete bed for molding and curing concrete and having the apparatus of the present invention attached thereto for aiding in the curing of such concrete.
Figure 2:
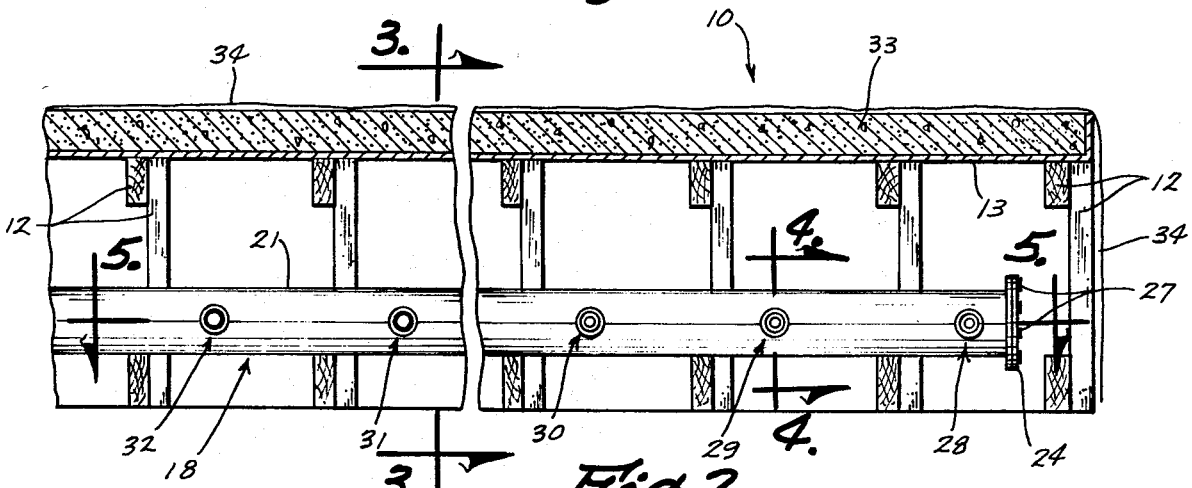
FIG. 2 is a cross-sectional view taken along line 2—2 of FIG. 1.
Figure 3:
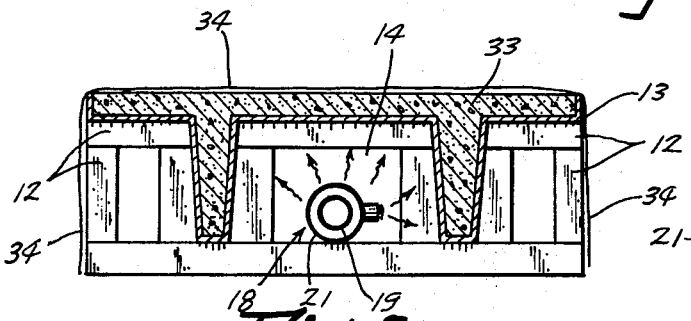
FIG. 3 is a cross-sectional view taken along line 3—3 of FIG. 2.

Referring now to the drawings where in like reference numerals designate identical or corresponding parts throughout the several views, FIG. 1 shows a concrete bed 10 having the concrete curing apparatus 11 of the present invention attached thereto.

The concrete bed 10 consists primarily of a frame 12 which holds up a mold 13. A generally longitudinal opening 14 is disposed along the length of the bed 10 and under the mold 13. A heating structure 16 is shown schematically in FIG. 1 and this heating structure 16 is normally of a variety which would burn oil or gas, but it is to be understood that any other source of heat can be used. An air circulating fan 17 is associated with the heating mechanism 16 for the purpose of forcing the heated air from the heating mechanism 16 to a heat distributing device 18. This heat distributing device 18 is shown in detail in FIG. 2-5 and includes a first conduit 19 which is connected directly to the heating and fan circulating mechanisms. The heat distributing device 18 also includes a second, outer conduit 21 which is disposed around the first conduit 19. The first and second conduits 19 and 21 are connected together by a partition wall 22 which forms one end of an annular passageway 23. It is to be understood that this annular wall 22 completely seals the annular passageway 23 from the outside air. Braces (not shown) can be used to maintain the concentric relationship of the inner conduit 19 with the outer conduit 21 if desired. An end plate 24 is bolted on to the second conduit 21 by means of flanges 26 and nut and bolt assemblies 27 which extend through the plate 24 and flanges 26.

Also attached to the second conduit 21 are a plurality of orifices or apertures 28, 29, 30, 31 and 32. The opening in each of the devices 28-32 are progressively larger from the right to the left as viewed in FIG. 5 for reasons which will be explained below. The holes 28-32 are equidistantly spaced from each adjacent hole along the length of the second conduit 21.

Figure 4:
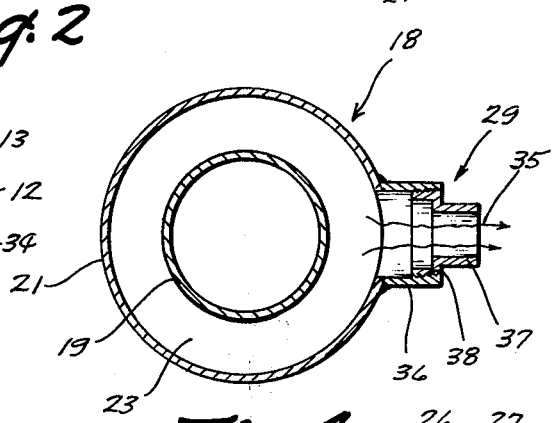
FIG. 4 is a partial cross-sectional view taken along line 4—4 of FIG. 2.

In construction, the aperture structures 28–32 are constructed as shown in FIG. 4. A sleeve 36 is welded to the conduit 21 and member 37 is threadably engaged with threads 38 on the interior of member 36.

In operation, concrete 33 would be poured into the molds 13. These molds can also include reinforcing structure within the concrete such as high strength cables which are tensioned, as is well know in this art. A cover 34, which is normally made of canvas, is then used to cover up the concrete and the entire concrete bed. Normally such cover is made of a plurality of canvas tarps, but it is to be understood that other types of covers are also suitable. The ends of the opening 14 are also sealed up in an appropriate manner to keep as much heat under the mold 13 as is feasible. Once this is done then the heater 16 and the fan 17 are activated so as to force heated air into the first conduit 19. Preferably the heater 16 is of a type which does not have a stack for venting the fumes of combustion to atmosphere, but instead these gaseous by-products of combustion are circulated with heated air into the first conduit 19. The heated air and heated gases pass through the gas imperious first conduit 19 in the direction of the arrows 35 and out the end 20 of the first conduit 19. The flow of hot air and gases continues to flow in the direction of the arrows 35 through the annular passageway 23 between the first conduit 19 and the second conduit 21 and out through the apertures 28-32.

Figure 5:
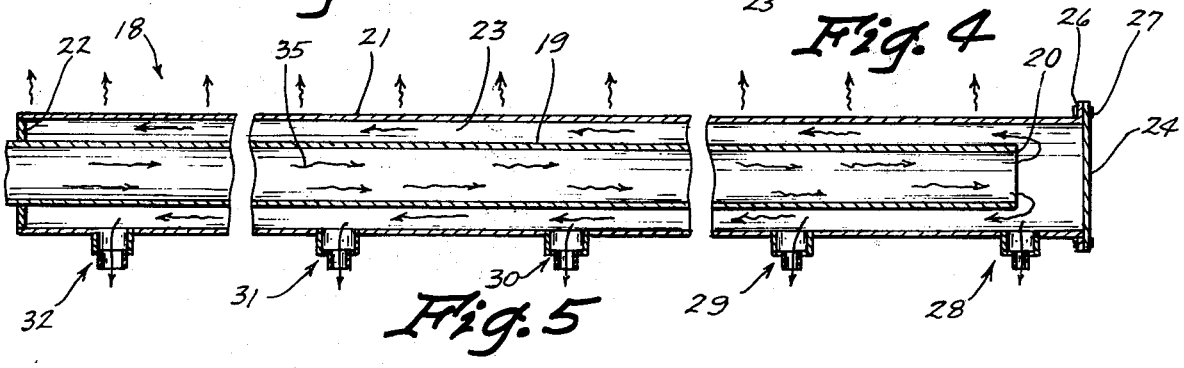
FIG. 5 is a cross-sectional view taken along line 5—5 of FIG. 2.

One reason that the apertures 28–32 are gradually bigger in size as viewed from the right to the left in FIG. 5 is that the pressure in the passageway 23 is greater near the opening 36 in the first conduit 19 than it is moving from that point to the left as viewed in FIG. 5. Consequently, the heated gaseous air exiting the aperture 28 is at a higher pressure than the air exiting the aperture 29, the air exiting at 30 is at a lower pressure than the pressure at 29, the heated air exiting the aperture 31 is at lower pressure than the air exiting the aperture 30, etc. Consequently, the graduated sizes of the opening is substantially inversely proportional to the pressure at that point so that substantially the same amount of heat is transmitted out of each one of the apertures 28–32 despite the fact that they are of different sizes. Additionally, there is a tendency for the heated air to cool as it moves in the passageway 23 from right to left as seen in FIG. 5. This tendency is substantially overcome because of the heat transmitted radially outwardly through the walls of the first conduit 19. This first conduit 19 tends to be somewhat warmer nearer the heater than near the end 20 thereof and these factors tend to also contribute towards the even distribution of heat using this preferred embodiment.

Once sufficient heat has been supplied to the opening under the mold 13, and the concrete 33 has dried, the concrete structure 33 is removed and the process can be repeated.

Accordingly, it can be seen that the preferred embodiment does indeed accomplish the objects referred to above. Obviously many modifications and variations of the present invention are possible in light of the above teachings. It is therefore to be understood that, within the scope of the appended claims, the invention may be practiced otherwise than as specifically described.

I claim:

1. Apparatus for curing concrete including a frame, a mold disposed on said frame for receiving concrete in a moldable condition, an opening disposed under said mold, a heat distributing means disposed in said opening for evenly distributing heat to said mold, heater means attached to said heat distributing means for supplying heat to said heat distributing means, circulating means for causing heat from said heater means to flow to said heat distributing means, said heat distributing means comprising:

a first rigid conduit, said first conduit being attached at one end thereof to and in communication with said heater means, said first conduit having sidewalls impervious to the flow of gases, the other end of said first conduit being open;

a second rigid conduit sealingly disposed around said first conduit and encompassing said other end of said first conduit;

passageway means formed between said first and said second conduits, said other end of said first conduit being in fluid communication with said passageway means whereby heated gases from said heater means pass through said first conduit and out the other end thereof into said passageway means;

aperture means disposed in said second conduit in communication with said passageway means and in communication with the opening under said mold for substantially evenly distributing heated gases to said mold along the length of said mold for evenly curing the concrete with said mold;

said heater means comprising a heater for burning fuel for producing heat and by-products of combustion, said circulation means adapted to force heated air and by-products of combustion from said heater means to said first conduit whereby heat is not lost through a stack for venting out by-products of combustion.

2. The apparatus of claim 1 whereby said aperture means includes a plurality of holes in said second conduit, said holes being equi-distantly spaced from each adjacent hole along the length of said second conduit and whereby said holes are progressively larger from a point adjacent said one end of the first conduit to a point adjacent the other end of the first conduit.

3. The apparatus of claim 1 including means for covering said mold and sealing the ends of said opening under said mold.

4. The apparatus of claim 1 whereby said passageway means is annular and surrounds said first conduit.

* * * * *